United States Patent [19]

Grathoff

[11] Patent Number: 4,573,743

[45] Date of Patent: Mar. 4, 1986

[54] BUCKETWHEEL EXCAVATOR WITH OSCILLATING NOZZLES

[75] Inventor: Hartmut Grathoff, Wendelstein, Fed. Rep. of Germany

[73] Assignee: M.A.N. Maschinenfabrik Augsburg-Nurnberg, Nuremberg, Fed. Rep. of Germany

[21] Appl. No.: 681,543

[22] Filed: Dec. 14, 1984

[30] Foreign Application Priority Data

Dec. 22, 1983 [DE] Fed. Rep. of Germany ..... 3346306

[51] Int. Cl.[4] ..... E21C 25/60

[52] U.S. Cl. ..... 299/39; 299/17; 299/67; 37/78; 37/141 R; 37/190

[58] Field of Search ..... 37/DIG. 1, 78, 63, 62, 37/1, 190, 189, 141 R; 299/17, 16; 405/163; 175/67; 299/39, 67

[56] References Cited

U.S. PATENT DOCUMENTS

| | | | |
|---|---|---|---|
| 3,554,602 | 1/1971 | Chaney | 37/189 X |
| 4,167,292 | 9/1979 | Eller | 299/17 X |
| 4,418,484 | 12/1983 | Wolters et al. | 37/63 |

FOREIGN PATENT DOCUMENTS

| | | | |
|---|---|---|---|
| 3049216 | 7/1982 | Fed. Rep. of Germany | 299/17 |
| 3222580 | 2/1984 | Fed. Rep. of Germany | 299/17 |
| 2125850 | 3/1984 | United Kingdom | 299/17 |
| 540990 | 12/1976 | U.S.S.R. | 37/DIG. 1 |
| 591575 | 2/1978 | U.S.S.R. | 299/17 |
| 712482 | 1/1980 | U.S.S.R. | 37/189 |

OTHER PUBLICATIONS

Reichman et al., "An Oscillating Waterjet Deep-Kerfing Technique", *Int. J. Rock Mech. Min. Sci. & Geomech. Abstr.*, vol. 15, pp. 135-144, 1/1978.

*Primary Examiner*—Clifford D. Crowder
*Attorney, Agent, or Firm*—Felfe & Lynch

[57] ABSTRACT

Instead of teeth or similar cutting or loosening means, oscillating nozzles are arranged on the outer backs and the outer side walls of the buckets of the bucketwheel of a bucketwheel excavator, the nozzles being capable of being supplied with liquid, in particular water, at high pressure. These nozzles enable the excavator to strip or mine deposits of high hardness and strength as well as highly abrasive deposits with reduced outage periods and reduced force required for digging as well as lower capital costs and operating costs. In addition to the oscillating nozzles, fixed nozzles may additionally be provided which produce cuts in the material to be excavated whereby the formation of large lumps is prevented.

11 Claims, 10 Drawing Figures

BUCKETWHEEL EXCAVATOR WITH OSCILLATING NOZZLES

This invention relates to a bucketwheel excavator having a bucketwheel with the buckets being provided with cutting edges.

Bucketwheel excavators whose buckets only have cutting edges primarily serve to remove material that is not too hard. By fitting special knife edges, teeth or similar elements onto the cutting edges it is possible to dig harder materials, but the force required by the bucketwheel to dig into the material and, consequently, the power requirements for the bucketwheel drive and the outage periods of the excavator due to the replacement of worn teeth or similar elements are increased. True, it is possible where highly abrasive material is handled to extend the life of the teeth to several hundreds of operating hours by hard-facing and deposit welding but this does not change the inherent drawback of undesirable outage periods and need for increased force for digging arising.

For the extraction of materials of high hardness and strength, it is often necessary to make the material to be dug capable of being dug with the bucketwheel excavator by fragmentation blasting.

This invention has for an object to further develop a bucketwheel of the type initially referred to in a manner to enable it also to dig material of high hardness and strength as well as highly abrasive material while keeping outage periods and the force to be applied for digging by the bucketwheel at relatively low levels. Furthermore, it is intended to lower the capital costs and the operating costs of open-cast or strip mining.

According to the invention, this object is achieved in that oscillating nozzles are arranged on the outer backs of the buckets and on the outer sides of the buckets, the nozzles being capable of being supplied with liquid, in particular water at high pressures.

As a result of the cutting by means of high pressure liquid jets according to the invention, separating fissures are cut into the material to be removed so that the cutting edges of the buckets following the jets are capable of dislodging and picking up the material with a relatively low expenditure of force. Compared to bucketwheel excavators with additional teeth or similar elements, the force required by the bucketwheel for digging is substantially reduced. Since, furthermore, no teeth or similar elements have to be replaced, there are no outage times and the availability of the bucketwheel excavator and the equipment cooperating with it is enhanced. Finally, there is no need for fragmentation blasting.

The advantages obtainable by cutting with high pressure liquid jets have a favorable effect on the complete bucketwheel excavator because weight saved in the buckets, in the bucketwheel body, in the bucketwheel drive etc. permit further weight reductions in the general structure of the excavator.

Where the material tends to form unacceptably large lumps when dug with the bucketwheel, this can be remedied in that additional nozzles (fixed nozzles) which emit the high pressure liquid in a constant direction relative to the buckets are provided on the buckets—in addition to the oscillating nozzles—part of these nozzles being arranged on the outer back of the buckets and emitting in a roughly radial direction and the other part of the nozzles being arranged on the outer sides of the buckets and emitting the liquid in each direction in which the bucketwheel boom is rotated.

Preferably, the fixed nozzles are controlled so that those nozzles (fixed nozzles) arranged by the sides of the buckets emit jets of liquid over a bucketwheel slew angle range of about 0° to ±45° and the nozzles (fixed nozzles) arranged on the bucket backs emit liquid jets in the bucketwheel boom slew angle range of about ±40° to ±80°.

A further feature of the invention provides for the nozzles to be started and stopped separately, the nozzles having valves, typically electrically controllable valves allied to them. This makes it possible to start only those nozzles that are allied with those parts of the bucket cutting edges that are digging which results in a substantial reduction in the amount of high pressure liquid required.

Where the nozzles (oscillating nozzles or oscillating and fixed nozzles) are connected by means of a pipe system to a high pressure pump, it is advantageous for reasons of weight to have the high pressure pump located on the structure of the excavator away from the bucketwheel boom.

A further development of the invention consists in connecting the nozzles to a common ring mains arranged on the periphery of the bucketwheel body with the valves being arranged between the ring mains and the nozzles. The provision of the common ring mains results, in particular, in a simplification of the pipe routing.

A protected arrangement of the valves is obtained, if these are located inside the space delimited by the bucketwheel body.

The number of pipe joints required to be separated for replacing the buckets is especially small if—according to another feature of the invention—all valves allied to the nozzles of a bucket are combined in one unit.

It may also be advantageous to have each nozzle form a unit with the allied valve.

In order to ensure that only those nozzles (oscillating nozzles or oscillating and fixed nozzles) are activated that are allied to those parts of the cutting edges of the buckets that are actually in the process of digging into the material to be excavated, the valves allied to the nozzles are actuated by a common central electric control system which preferably is a microprocessor. To this end, this control system has the following data input in the form of electrical signals, viz:

(a) bucketwheel drive on or off (b) momentary value of bucketwheel rotation via a transmitter on the bucketwheel shaft or any other gear-shaft, a gear—in the latter case—between this shaft and the transmitter ensuring that the transmitter has exactly the same speed as the bucketwheel, (c) momentary value of the bucketwheel boom slew speed, e.g. supplied by a tacho-generator on one of the motors rotating the superstructure of the excavator, (d) the momentary value of the bucketwheel slew direction, (e) the momentary value of the bucketwheel slew angle via a transmitter that monitors the position of the excavator superstructure relative to the excavator base structure, (f) height of layer—which may be input, for instance, manually by the excavator operator, (g) advance path of the excavator travel mechanism, which may be detected, for instance, by a displacement transmitter on the road-wheel of a crawler or on the tumbler of the crawler or on a gear-shaft of the crawler drive, (h) bucketwheel direction of rotation; (only required for excavators which are equipped for high level and low level cutting), and (i) positioning of the bucketwheel boom hoist by means of a transmitter on the hoist; (only required for operation of the excavator for drop cuts).

For the purpose of supplying the power of actuating the valves to the bucketwheel, the bucketwheel shaft is provided with a slip ring body. Analogously, a rotary feeder penetration is required for the high pressure level liquid at one of the two ends of the bucketwheel shaft.

If the nozzles are connected by means of a high pressure line system to a high-pressure pump which, in turn, communicates via a low-pressure line system with a low-pressure source of liquid, then it is advantageous according to a further development of the invention to provide a dosing device ahead of the high-pressure pump for admixing media which will enhance the cutting action of the liquid jet. The operator of the excavator can use the dosing device systematically, for instance he would resort to admixing of the medium by activating the dosing device only temporarily while harder rock layers are encountered.

For a better understanding of the present invention, together with other and further objects thereof, reference is made to the following description, taken in connection with the accompanying drawings, and its scope will be pointed out in the appended claims.

In accordance with the invention, a bucketwheel excavator comprises a bucketwheel having buckets including cutting edges, outer backs and outer side walls. The excavator also includes oscillating nozzles arranged on the outer backs of the buckets and on the outer side walls of the buckets. The nozzles are capable of being supplied with liquid at high pressure.

Referring now to the drawings.

Figure 1:
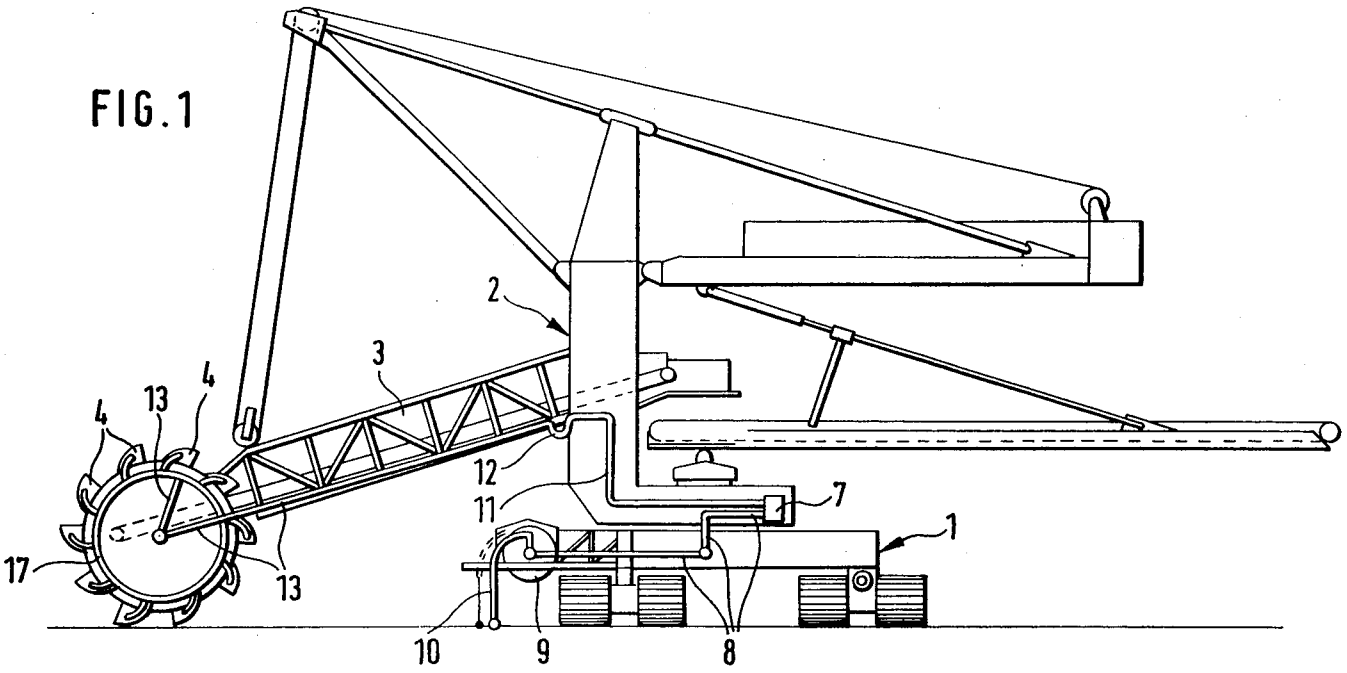
FIG. 1 is a side elevational view of a bucketwheel excavator.

The mobile bucketwheel excavator is formed in a manner known per se with a base 1 incorporating a crawler travel mechanism and a superstructure 2 supported rotatably on the base having a raisable and lowerable bucketwheel boom 3.

The bucketwheel which is rotatable under motor power is formed on its periphery with a plurality of equally spaced buckets 4 in sequence of which only part—e.g. three—are simultaneously digging during excavating operations. The buckets 4 are formed with substantially trapezoidally shaped receiving openings which are de-limited by cutting edges 5, 5' (FIG. 4) both at their faces which are parallel to the bucketwheel axis and the sides which extend substantially perpendicular thereto. The side walls of the buckets 4 are raked relative to the longitudinal center plane of the bucketwheel so that a side clearance angle is obtained behind the side cutting edges 5' as they dig into the material to be extracted.

Behind the transverse cutting edge 5 and the side cutting edges 5', each bucket 4 is formed with a plurality, e.g. three oscillating nozzles 6 per cutting edge, i.e. nozzles which turn quickly to and fro through a predetermined angle about an axis situated at right angles to the bucket cutting edge. These oscillating nozzles 6 are arranged in the space of the clearance angle. In the case of the oscillating nozzles allied to the transverse cutting edge 5, this is the space between the bucketwheel cutting circle and the back of the bucket and, in the case of the oscillating nozzles allied to the side cutting edges 5', it is the space between the outer side surface of the bucket and the surface contacting the cutting edge and formed by the resultant vectors of bucketwheel tip speed and bucketwheel boom slewing speed. The oscillating nozzles 6 are set back from the allied cutting edge 5, 5' so far that the jets emitted from their orifices cover their full length a short distance in front of the cutting edge.

Figure 2:
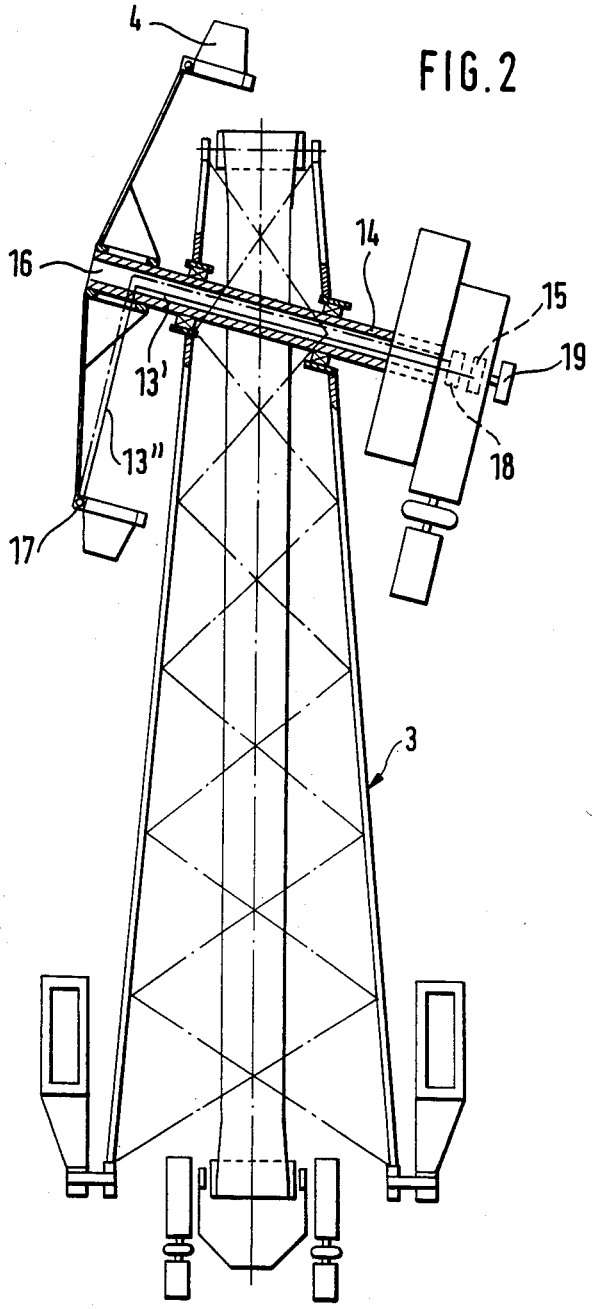
FIG. 2 is a plan view of the bucketwheel boom.
Figure 3:
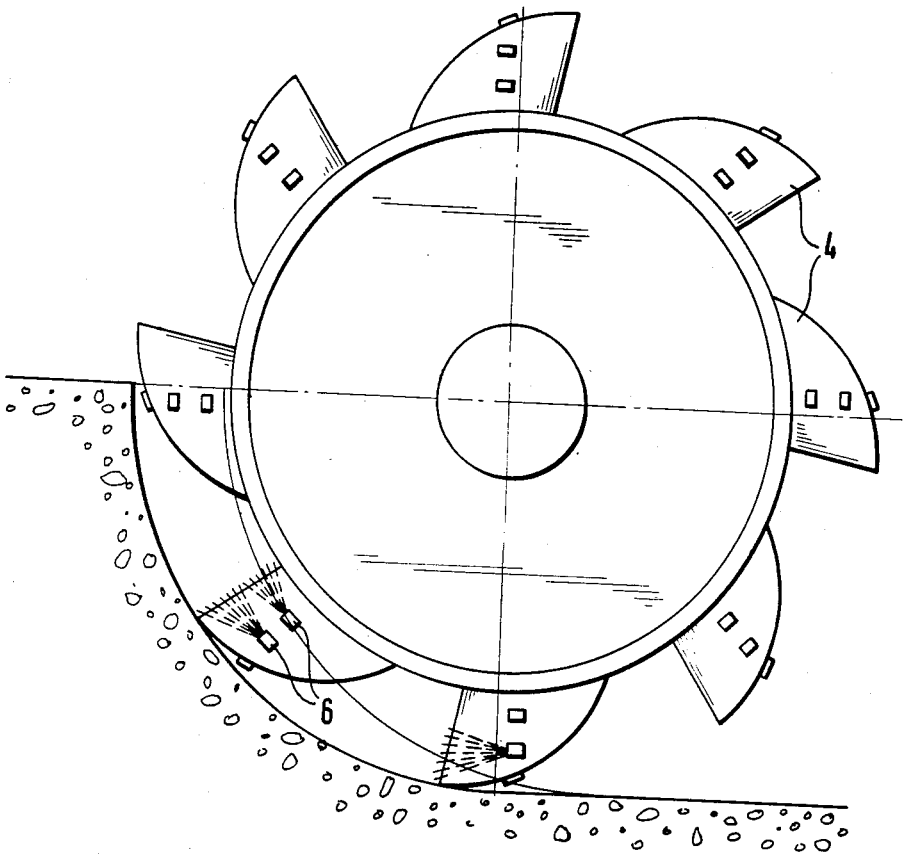
FIG. 3 is a side elevational view of the bucketwheel.

The oscillating nozzles 6 have throat diameters of the order of 0.5 to 2.0 mm and water is supplied to them at a very high pressure, e.g. 500 to 1000 bar and more. Generation of the high pressure is by means of a high-pressure pump 7 which is located on the super-structure 2 of the bucketwheel excavator at the center of the unit and—in order to reduce the amount of counterweight—as far as possible away from the vertical centerline of the bucketwheel excavator towards the rear. The low-pressure water supply to the high-pressure pump 7 is by means of a line 8 from a connection on a hose reel 9 on the base structure 1 of the bucketwheel excavator. The hose 10 coiling onto and off the hose reel 9 is connected with a source of water outside the bucketwheel excavator. The pipeline 8 is led from the high-pressure pump 7 in the superstructure horizontally to a point at the center of the slewing platform and from there via a rotary feeder penetration to the understructure 1 of the excavator and from there horizontally to the connection on the hose reel 9. The high-pressure water is delivered via a pipeline 11 in the superstructure 2 up to the level of the bucketwheel boom, from there via a flexible hose 12 to the bucketwheel boom and thence via a pipeline 13 in the bucketwheel boom as far as the area of the bucketwheel axle (bucketwheel shaft) 14 (FIG. 2). The transfer of the high-pressure water from the line 13 on the bucketwheel boom to a pipe on the bucketwheel body is by means of a rotary penetration device 15 of a type known per se in hydraulics engineering which can be arranged at both ends of the bucketwheel axle (bucketwheel shaft) 14. The high-pressure water then passes through a line 13' in a longitudinal drilled hole 16 in the bucketwheel axle 14 and a radial pipeline 13'' to a ring mains 17 which is arranged on the periphery of the bucketwheel, preferably inside the space enclosed by the bucketwheel body. From the ring mains 17, water is supplied to all oscillating nozzles 6 and all fixed nozzles 21.

Between the ring mains 17 and the oscillating nozzles 6 and fixed nozzles 21, there is an electrically controllable valve each so that all oscillating nozzles and fixed nozzles are capable of being cut in and cut out separately from each other.

Figure 5:
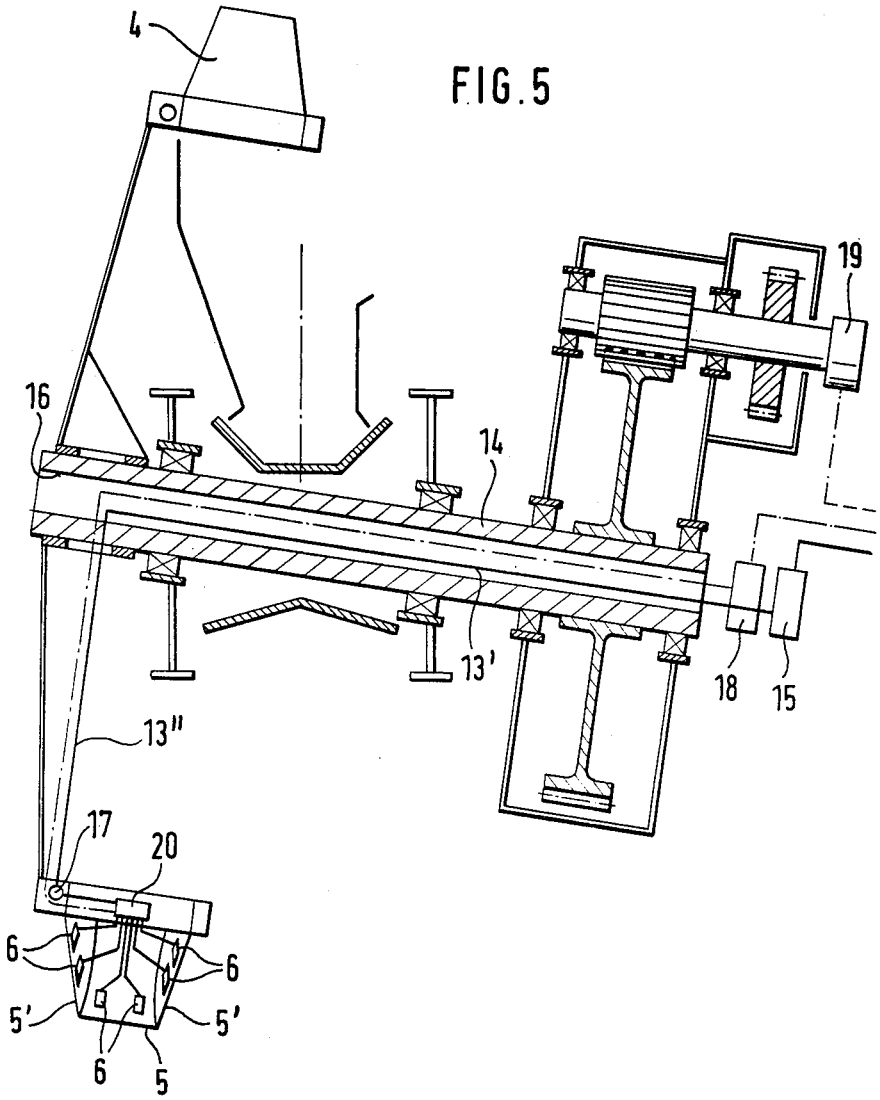
FIG. 5 is a partially sectioned view of the bucketwheel with its drive.

The valves allied to the nozzles of any one bucket 4 are arranged at suitable locations inside the bucketwheel body for protection. In order to require only one detachable pipe joint for bucket replacements, it is also possible to have all valves allied to the nozzles of one bucket combined in one unit 20 (FIG. 5) and arranged at a protected point on the back of the bucket, preferably between the rear bucket fastenings. However, it is also possible to have each nozzle with its allied valve combined in an encapsulated unit.

The transfer of power to the bucketwheel is effected in a manner known per se by means of a slip ring body 18 which is arranged at one end of the bucketwheel axle (or bucketwheel shaft) 14 on the latter. Where the bucket wheel is overhung/mounted, the rotary penetration and slip ring body are proposed to be arranged both at the gearbox-end of the bucketwheel axle (bucketwheel shaft) where they are protected and accessible. Alternatively, the slip ring body may be arranged at the end of the bucketwheel axle 14 where the rotary penetration is also arranged, or the rotary penetration and the slip ring body may be arranged at different ends of the bucketwheel axle.

Figure 4:
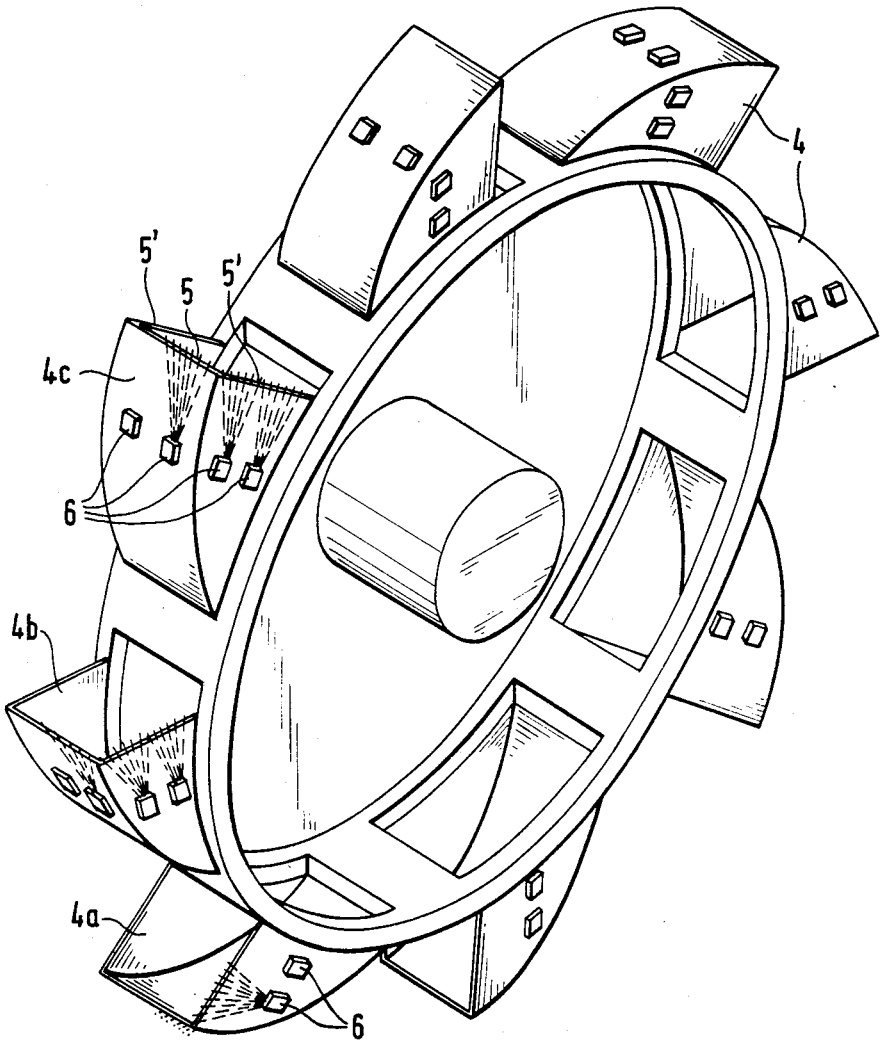
FIG. 4 is a perspective representation of the bucketwheel.

FIG. 4 is a typical arrangement illustrating the statement that only those oscillating nozzles are activated which are allied to that part of the cutting edges that is actually digging. On the strength of the geometry of the comma-shaped cut made by the bucket 4 in the phase illustrated, the buckets 4*a*, 4*b* and 4*c* have each an oscillating nozzle 6 of the transverse cutting edge 5 activated and the bucket 4*a* has one and the buckets 4*b* and 4*c* have each two oscillating nozzles 6 activated on the one side cutting edge 5'. All other oscillating nozzles are deactivated in this phase.

To protect the momentarily jet-producing oscillating nozzle, it should be activated somewhat before the theoretical time the cutting edge starts digging and somewhat after the end of digging (the advance and lag being each of the order of 10 cm), since the actual geometry of the bucketwheel engagement invariably deviates to a certain extent from the theoretical geometry.

The action of the high-pressure water jet can be increased in a manner known per se by the addition of, for instance, polymers with long chain molecules. Admixing of the additives is by means of a dosing device arranged upstream of the high-pressure pump and which is activated only by the excavator operator when harder rock layers are encountered temporarily. The dosing device preferably operates so that the mixing ratio is variable from zero to a percentage which corresponds to the maximum action of the high pressure water jet.

Where the bucketwheel excavator is used in temperature ranges below 0° Celsius, the pipework and hoses for delivering the water and high-pressure water are to be provided with heat insulation and provision should be made for heating them. It is also possible to add anti-freeze or combined additives that will lower the freezing temperature and enhance the cutting effect of the high-pressure water jet.

Figure 6A:
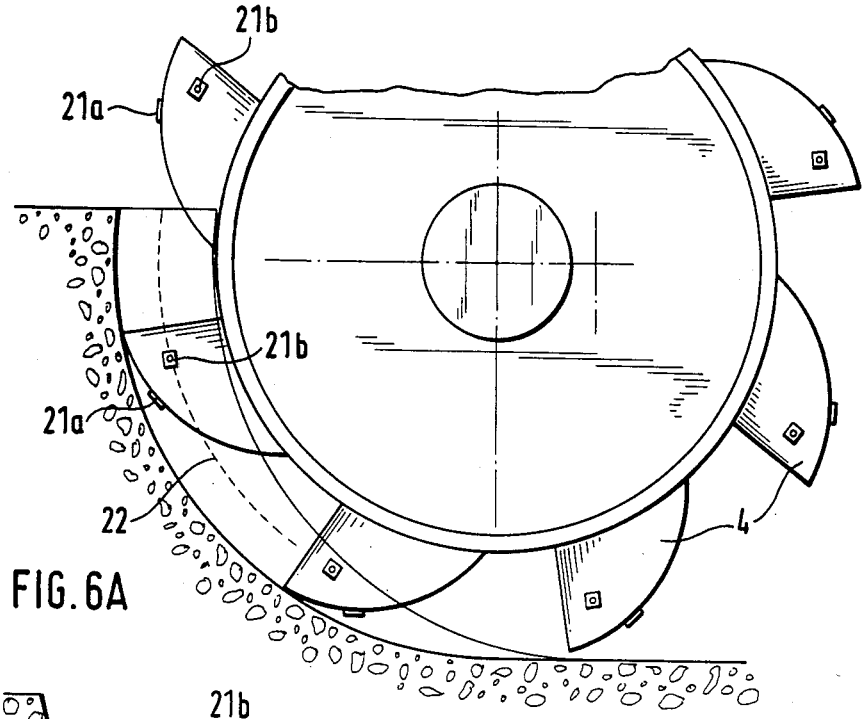
FIGS. 6A, 6B are side elevational views of bucketwheels with fixed nozzles operating in the terrace-cutting mode (FIG. 6A) or drop-cutting mode.
Figure 6B:
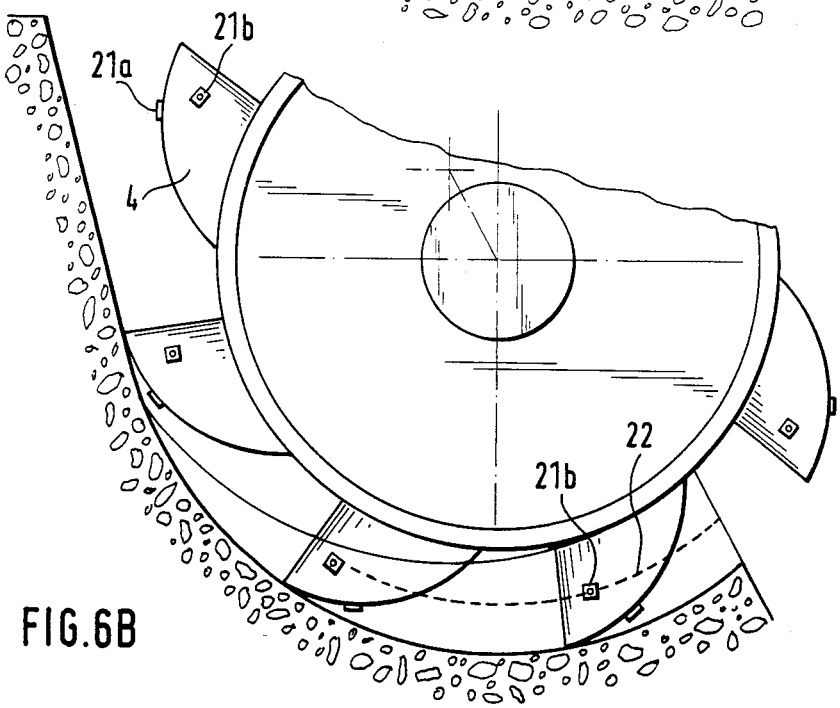

Bucketwheel excavators with oscillating nozzles or oscillating and fixed nozzles supplied with high-pressure water according to the invention can advantageously be used wherever material of high hardness and strength or highly abrasive material has to be dislodged or extracted. Special applications are in stripping or extracting sandstone or sandstone-like materials, in the mining of bituminous coal, tar sand, oil shale and other deposits.

Where the material to be excavated tends to form unacceptably large lumps when dug by means of the bucketwheel, a remedy can be adopted in the form of additional fixed nozzles 21*a*, 21*b* (FIGS. 6A and 6B). These nozzles 21*a*, 21*b* will emit water jets in a constant direction relative to the allied bucket and not as oscillating jets.

One (or several) of these fixed nozzles (21*a*) is (are) arranged on the back of the bucket to emit a jet (or jets) substantially in a radial direction relative to the bucketwheel. One (or several) of these fixed nozzles (21*b*) is (are) arranged on each side of the bucket to emit a jet or jets in the slewing direction.

It is common practice today for bucketwheel excavators to dig without advancing in a manner that crescent-shaped cuts 23 (FIG. 7A) are produced in plan.

Figure 7A:
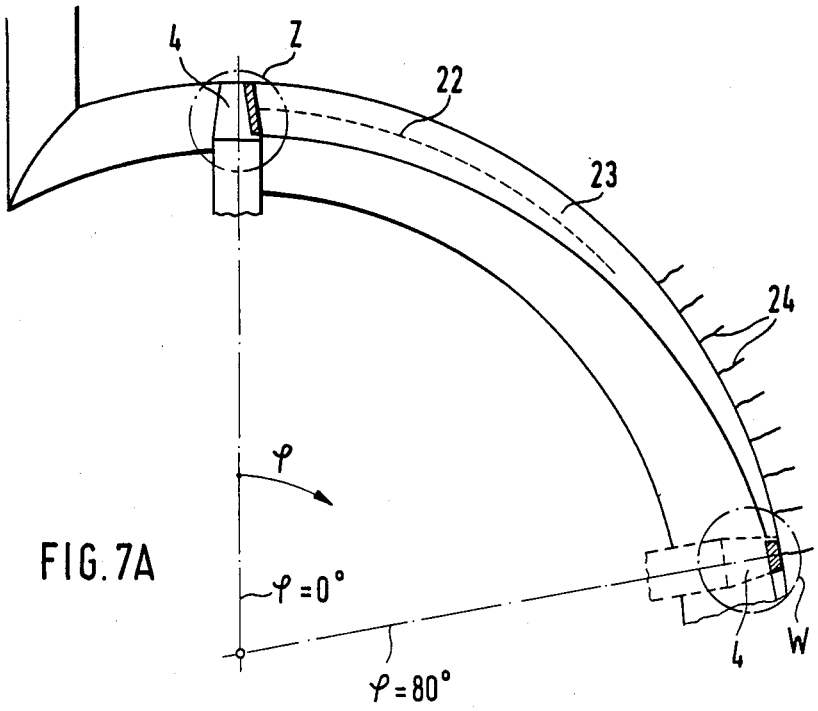
FIG. 7A is a plan view of the block to be extracted with two positions of the schematically represented bucketwheel boom.
Figure 7B:
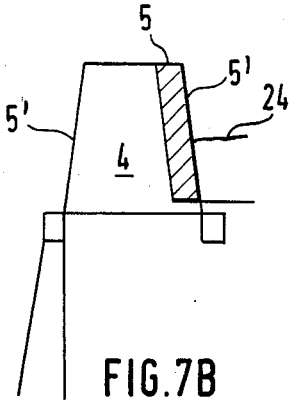
FIGS. 7B, 7C are enlarged details Z, W in FIG. 7A.

In the case of small slew angles $\phi$ relative to the travel direction of the machine, each bucket 4 will dig a substantially rectangular cut in cross-section whose long side is delimited by a side cutting edge and whose short side is delimited by the transverse cutting edge (see representation in FIG. 7B for slew angle $\phi=0°$).

With decreasing slew angle $\phi$, the edge length of the cut bounding the side cutting edge becomes increasingly smaller. In order to obtain a constant delivery rate, the slewing speed is increased as the slew angle increases.

Figure 7C:
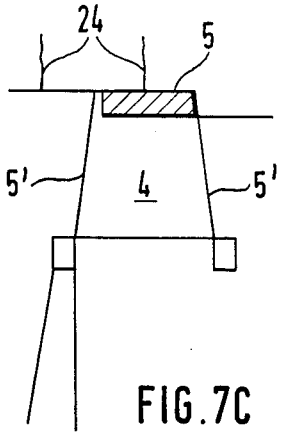

In the case of large slew angles, each bucket will dig a rectangular cut whose long side is bounded by the transverse cutting edge and whose short side is bounded by a side cutting edge (cf FIG. 7*a*, 7*c* with the bucketwheel boom in its end position).

The fixed nozzles 21 will produce cuts 24 in the material that has not yet been dug and these cuts will produce points where the "chip" preferably breaks. The path of the lateral fixed nozzles 21*b* while they are working, i.e. with the fixed nozzles actuated, is indicated by the dotted line 22 in FIGS. 6, 7*a*.

These fixed nozzles 21, too, are controlled by an electric control system—preferably by a microprocessor—so that they work only as long as their action is required.

In the area of small slew angles (>0°), the fixed nozzle (or fixed nozzles) on the side of the bucket in the slewing direction will operate (on the side of the bucket leading in the slewing direction). As a result, the "chip" dug by the following bucket is divided on its long side.

In the area of large slew angles (40°–80°), the fixed nozzle (or fixed nozzles) on the back of the bucket are operative.

As a result, the "chips" are subdivided during the next slewing movement of the bucketwheel boom on their long side.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A bucketwheel excavator for use in open-pit mining for the loosening and removal of material of great hardness and great strength or of highly abrasive material, e.g. sandstone, bituminous coal, tar sand, oil shale and the like, comprising:

a bucketwheel rotatable about a horizontal axis, having buckets provided with bucket backs and outer side walls and transverse and lateral cutting edges; and a nozzle system, liquid being dischargeable under high pressure from orifices of nozzles for cutting seams into the material to be mined, said nozzle system including oscillating nozzles which can be oscillated back and forth each in a plane about an axis disposed at right angles to a particular bucket cutting edge, said oscillating nozzles being disposed on the outside of said bucket backs and on said side walls of said buckets, said oscillating nozzles being disposed in a clearance angle space, the clearance angle space in the case of oscillating nozzles provided on the side of said transverse cutting edges being the space between the bucketwheel cutting circle and said bucket backs, and in the case of oscillating nozzles provided on the side of said lateral cutting edges, the clearance angle space being between said outer side walls and the surface that is engaged by a lateral cutting edge and is formed from the vectors resulting from the bucketwheel circumferential speed and the bucketwheel boom slewing speed, and said oscillating nozzles being set back from the associated cutting edge to such an extent that the liquid jets emerging from their orifices sweep the entire length of the associated cutting edge a short distance in front of it.

2. A bucketwheel excavator in accordance with claim 1, which includes a bucketwheel boom and a bucketwheel body and a common annular conduit disposed on the periphery of said bucketwheel body, said conduit being disposed on the excavator outside of said bucketwheel boom, said nozzles being connected to said conduit, and the excavator including between said annular conduit and said nozzles controllable valves allied to said nozzles, said valves being so operated that only those nozzles are turned on which are associated with a part of the cutting edges that is in engagement.

3. A bucketwheel excavator in accordance with claim 2, which includes a bucketwheel axle, a conduit portion in said bucketwheel boom, a rotary penetration device at one of two ends of said axle, a conduit system adjoining said annular conduit and connected in said bucketwheel body to said conduit portion in said bucketwheel boom through said rotary penetration device.

4. A bucketwheel excavator in accordance with claim 2, in which said valves are electrically operated valves and which includes a slip ring body on said axle for transmitting electrical signals to control said nozzles.

5. A bucketwheel excavator in accordance with claim 2, in which said valves are arranged inside the space enclosed by the body of said bucketwheel.

6. A bucketwheel excavator in accordance with claim 2, in which all valves allied to the nozzles on any one bucket are combined in one unit which is arranged on the outer back of the bucket for protection.

7. A bucketwheel excavator in accordance with claim 2, in which each nozzle forms a unit with the allied valve.

8. A bucketwheel excavator in accordance with claim 2, which includes a common central electric microprocessor control system and in which said valves allied to said nozzles are controlled by said common control system.

9. A bucketwheel excavator in accordance with claim 1, which includes a slewable bucketwheel boom and in which said buckets are provided with further nozzles emitting high pressure liquid jets in a constant direction relative to said buckets, a portion of said further nozzles being arranged on said outer backs of said buckets and emitting the jets in a substantially radial direction and the other portion of said further nozzles being arranged on said outer side walls of said buckets and emitting the jets in the momentary slewing direction of said bucketwheel boom.

10. A bucketwheel excavator in accordance with claim 9, in which said other portion of said further nozzles arranged on said outer side walls of said buckets emit jets in a bucketwheel boom slew angle range of about 0° to ±45° and said portion of said further nozzles arranged on said outer backs of said buckets emit jets in a bucketwheel boom slew angle range of about ±40° to ±80°.

11. A bucketwheel excavator in accordance with claim 1, in which said nozzles are capable of being activated and deactivated separately.

* * * * *